United States Patent [19]

Fisher et al.

[11] 4,206,669

[45] Jun. 10, 1980

[54] APPARATUS FOR GAPPING ZIPPER CHAIN

[75] Inventors: Harry Fisher; Stuart Fisher, both of Whitestone, N.Y.

[73] Assignee: Scovill Manufacturing Company, Waterbury, Conn.

[21] Appl. No.: 960,942

[22] Filed: Nov. 15, 1978

[51] Int. Cl.[2] ..... B29D 5/00

[52] U.S. Cl. ..... 83/212.1; 83/302; 83/921; 83/431; 83/436; 29/770; 29/408

[58] Field of Search ..... 83/921, 208, 212, 213, 83/214, 218, 302, 407, 431, 436; 29/766, 770, 408

[56] References Cited

U.S. PATENT DOCUMENTS

| | | | |
|---|---|---|---|
| 1,762,330 | 6/1930 | Fiedler et al. | 83/302 |
| 2,752,997 | 7/1956 | Soave | 83/436 |
| 3,611,545 | 10/1971 | Takamatsu | 29/408 |
| 3,831,474 | 8/1974 | Perlman | 83/921 |
| 3,844,017 | 10/1974 | Fisher et al. | 29/770 |
| 3,848,500 | 11/1974 | Takahashi | 83/921 |
| 3,913,432 | 10/1975 | Thaler et al. | 83/921 |

*Primary Examiner*—Donald R. Schran
*Attorney, Agent, or Firm*—Dallett Hoopes

[57] ABSTRACT

Apparatus for producing gaps in zipper chain is especially adapted for chain having plastic elements of U-shape joined by imbedded connector threads and stitched to tape. Apparatus includes slitting means which slice into and demolish fastener elements in the gap as the zipper is drawn along, and lancer elements which are periodically activated to cut the connecting threads at the beginning and end of the gap. Stitches and tape in gap are left intact.

4 Claims, 15 Drawing Figures

APPARATUS FOR GAPPING ZIPPER CHAIN

BACKGROUND OF THE INVENTION

1. Field of the Invention

This invention relates to apparatus for gapping zipper chain. More specifically, this invention relates to apparatus for removing interfitting fastener elements in a section of zipper chain so that the chain may be severed adjacent the section and a slider and appropriate end stops may be applied to produce a zipper of discrete length.

2. Description of the Prior Art

The prior art is replete with showings of apparatuses for gapping zipper chain, usually in which the fastener elements take the form of plastic coils stitched onto the tape with or without the use of a filler cord. Typically, the prior art apparatuses comprise a punch adapted to come down and engage the central portion of the interlocked lines of fasteners and to fracture that portion against the edges of a slot beneath the punch and to move the broken portions downward through the slot away from the tapes. An example is shown in the Perlmann patent U.S. Pat. No. 3,368,269, granted Feb. 13, 1968.

Occasionally in the past, as shown in British Pat. No. 881,929 (1959), apparatuses for gapping zipper chain have taken the form of a pair of co-planar cutter wheels disposed on opposite sides of the chain as it is drawn through the apparatus, the cutter wheels adapted to shear off the heads of the fastener elements on the respective stringers.

Many of the apparatuses for gapping zipper chain in the prior art while they may have performed their function, have weakened or severed the lines of sewing threads in the section of the zipper in which the elements have been removed. This has produced a product wherein the attachment of the line of fastener elements, particularly near the terminals of the fastener elements of the zipper, has not been secure and may have resulted in the failure of prior zipper products.

Additionally, the apparatuses for gapping zipper chain in the prior art have not coped with the problem of severing the connector threads of the lines of fastener elements described above in the Abstract and as shown, for instance, in U.S. Pat. No. 3,414,948, issued Dec. 10, 1968 to Cuckson et al. Clearly, if these connector threads are not severed, then the complete removal of the scoops in the gapped area is not possible by the apparatus and additional hand work is necessary to make a clean gap.

SUMMARY OF THE INVENTION

Under the present invention, means are provided to remove the interlocked fastener elements in the section to be gapped, not only the portions of the fastener elements which extend between the tapes, but also the portions which are outward of the lines of stitching. These means include slitters and narrow knives or lancers to sever the connecting threads. At the same time, apparatus embodying the invention does not disturb the sewing threads in the area of the gap. The resultant product is a clean, precisely gapped zipper chain wherein the tape is scarcely disturbed and the sewing threads remain intact assuring secure attachment of the fastening elements adjacent the gapped area.

More specifically, the invention is an apparatus including a housing on which are mounted a pair of heads disposed on parallel axes, the heads having outwardly projecting slitting means adapted to slice through and demolish the fastener elements in the gap. One of the heads carries lancer means adapted to cut the connector threads on both sides of the tape. The apparatus also includes means to pull the tape between the aforementioned heads.

BRIEF DESCRIPTION OF THE DRAWINGS

Other features and objects of the invention will be apparent to those skilled in the art from a study of the accompanying drawings and the following specification and claims, all of which describe a non-limiting embodiment of the invention.

In the drawings.

DESCRIPTION OF THE PREFERRED EMBODIMENT

Figures 1, 1A, 2:
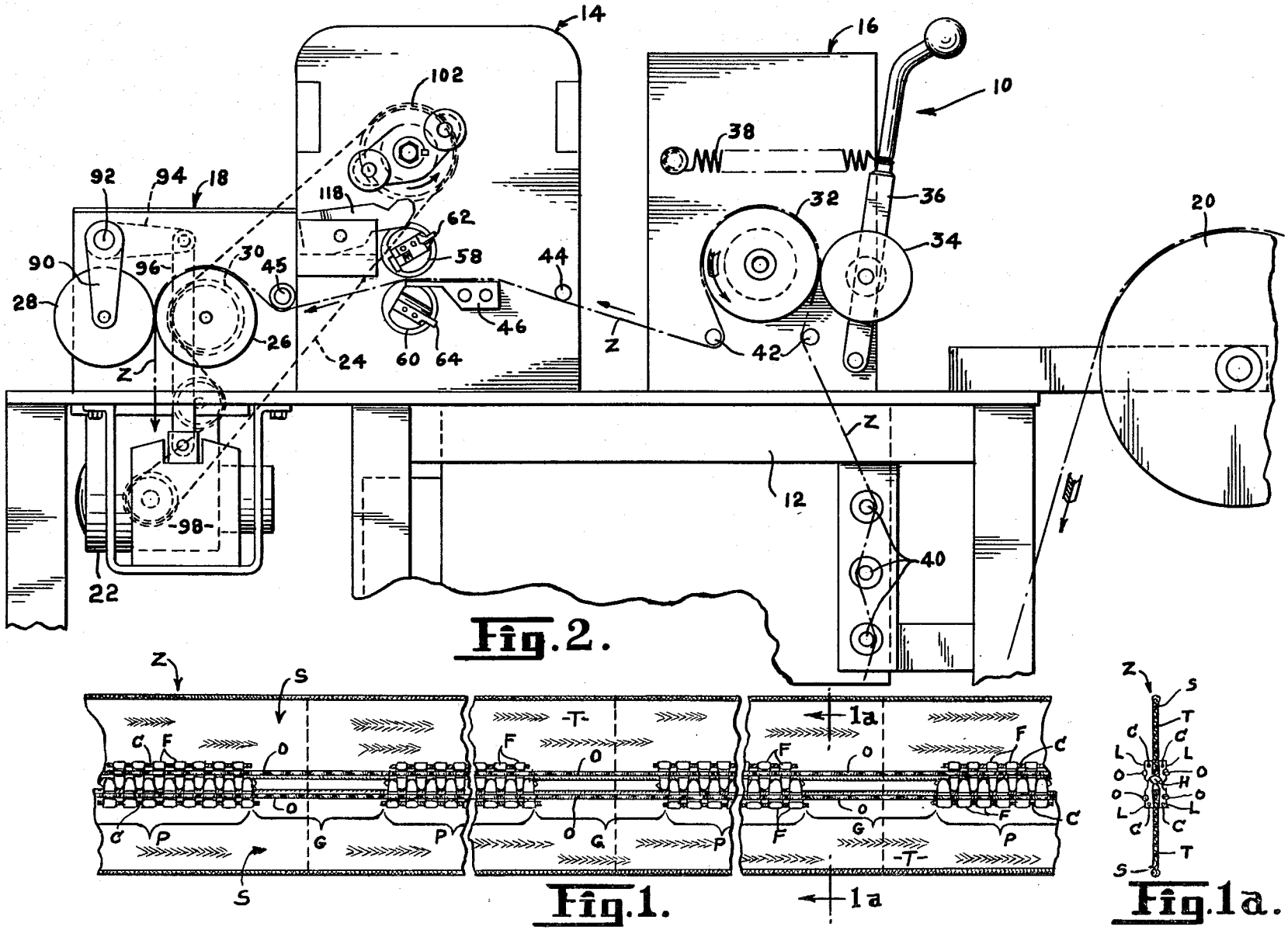
FIG. 1 is a plan view, broken to conserve space, of a slide fastener or zipper product of an apparatus embodying the invention.
FIG. 1*a* is a sectional view taken on the line 1*a*—1*a* of FIG. 1.
FIG. 2 is a front view, again partly broken away to conserve drawing space, of an apparatus embodying the invention.

For background, reference is made to FIGS. 1 and 1*a* wherein the zipper chain Z comprises a pair of stringers S each including a tape T, the adjacent edges of the tape T are straddled respectively by the elements in lines of fastener elements F, each of which (FIG. 1*a*) comprises a U-shaped element including a pair of legs L having a head H at their connecting bights. Into the rear or heel portion of each of the legs is embedded a connector thread C and lines of stitching O secure the lines of fastener elements to the tape.

It will be seen from FIG. 1 that a gap G is formed in the tape at periodic intervals to interrupt the lines of fastener elements so that the final product when severed, for instance, along the dotted lines shown, will produce a zipper of the desired length P of elements.

It is by the apparatus of the present invention that the gap G is made. It is to be noted that not only the fastener elements F are removed in the gap G without disturbing the sewing threads O, it is also to be noted that the connector threads C are severed at the beginning and end of each of the gaps G.

An apparatus embodying the invention is generally designated 10 in FIG. 2. For convenience, it comprises a legged support or table 12 on which are mounted the main gapping housing 14, the control unit 16, and the pulling unit 18. The control unit 16 includes setting and display means for the length of zipper, length of gap, number of zippers, etc. (all not shown).

Supported at the rightward end of the table is a supply reel 20 of zipper chain. A drive motor 22 is mounted under the table and by an appropriate chain 24 drives the pulling station 18 and the various moving parts on the housing 14.

It is to be noted that in the pulling station 18, the zipper chain Z passes between two counter-rotating drive wheels 26 and 28, which are pressed together by spring means to be described. Typically, the wheel 26 rotates about a fixed axis driven by the chain 24 through an appropriate sprocket 30 and the wheel 28 is an idler wheel engaging both the wheel 28 and the zipper thereon. In threading the zipper Z through the drive unit, the wheel 28 may be moved manually outward against spring pressure (not shown) away from the wheel 26.

From the drive unit 18, the finished zipper chain falls to a receiving receptacle, not shown.

The control station 16 likewise comprises a pair of wheels 32 and 34. The wheel 32 is a measuring wheel and means within the control unit 16 measures the amount of zipper that it engages as it turns. After a preset amount of rotation of wheel 32, the control station effects the discontinuance of the pulling of zipper and the engagement or disengagement of the gapping operation. It will be understood that the electronic equipment in the control station 16 is well known in the art and does not comprise part of this invention. It is referred to herein merely to enhance the understanding of the total apparatus.

As stated, the idler wheel 34 which is rotatably mounted on the arm 36 pivoted to the bottom of the control station and which is urged toward the wheel 34 by the spring 38 insures the non-slipping engagement of the zipper Z with the measuring wheel 32.

To assure tension and smooth passage of the zipper Z through the mechanism, various pins 40, 42, and 44 are provided as shown. The pin 44 mounted on the housing 14 assures the flat smooth delivery of the zipper Z to the grooved support bed 46. Pin 45 holds the zipper chain down against the bed as it moves thereoff.

THE GAPPING MECHANISM

Figure 12:
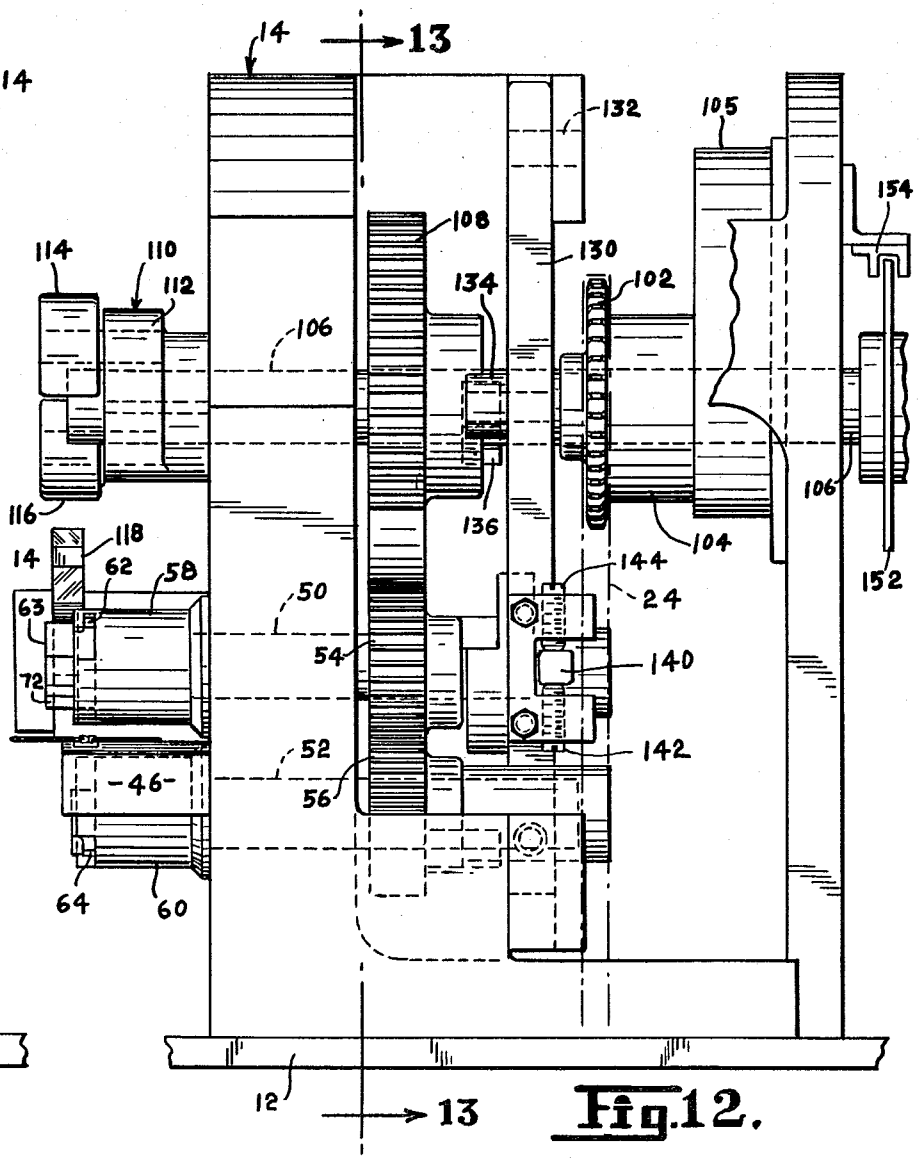
FIG. 12 is a right end view of the housing shown in FIG. 11.

As shown in FIG. 12, the housing 14 which is supported on the table 12, mounts an upper and lower shaft 50, 52 for rotation. These shafts are parallel and spaced and are keyed to rotate together in opposite senses by the intermeshing of identical pinions 54, 56.

Figures 3, 4, 5, 6, 7, 8, 9, 10:
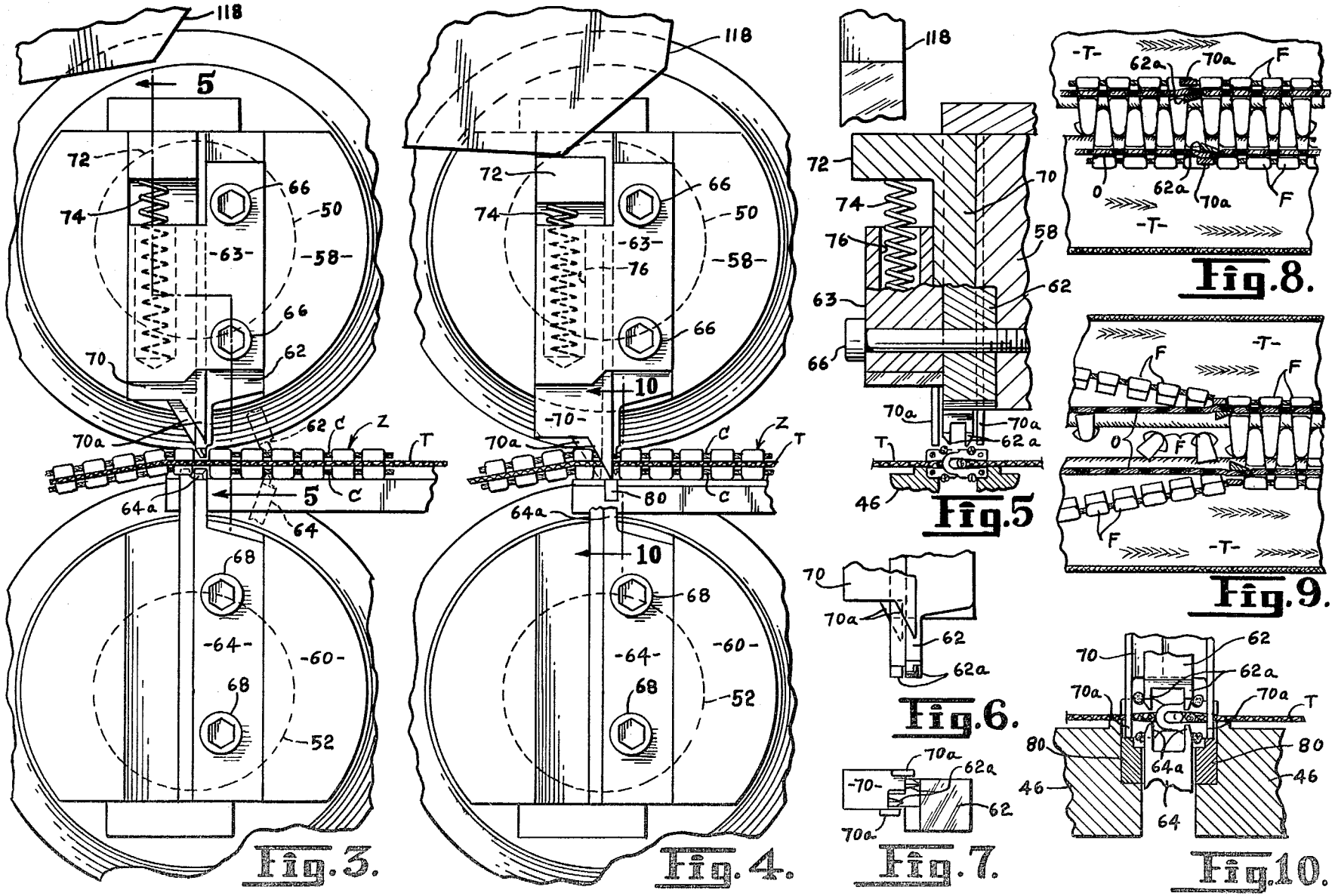
FIG. 3 is a fragmentary enlarged view showing the slitter means engaging a zipper chain Z.
FIG. 4 is similar to FIG. 3 but shows the lancer element piercing connector threads C and tape T of the zipper Z.
FIG. 5 is a sectional view taken on the line 5—5 of FIG. 3.
FIG. 6 is a fragmentary side view of the operating elements of the upper head.
FIG. 7 is a bottom view of the elements shown in FIG. 6.
FIG. 8 is an enlarged drawing of a portion of zipper between the heads with the cutting means as shown in the position of FIG. 4 at the commencement of the gap.
FIG. 9 is similar to FIG. 8 but showing the cutting means in the position of FIG. 4 at the end of the gap and showing the fragments of fastener elements as they would appear in the gap area.
FIG. 10 is a sectional view on the line 10—10 of FIG. 4.

The forward ends of the shafts 50, 52 are provided with the heads 58 and 60 shown at the front of the apparatus (FIG. 2). Extending radially from the heads in substantially aligned relationship are the respective slitting means or slitters 62 and 64. The upper slitter 62 is clampingly held on the head 58 by end plate 63 held respectively by bolts 66 (FIG. 3). Lower slitter 64 is directly bolted to the head 60 by bolts 68.

As shown in FIG. 7, each of the slitters 62 and 64 comprises a pair of spaced slightly offset slitting blades 62*a* which are formed with sharpened leading surfaces and are long enough when in their working position (FIG. 3) to extend into the line of fasteners but not extend quite to the tape T. As shown in FIG. 8, preferably they are disposed just inside the lines of sewing thread O and are wedge-shaped so that as the tape is drawn past them, the slitters serve to plow the lines of thread O outward and to cut the individual fastener elements (FIG. 5) in the necked-in portion of the elements on which the thread O normally rests.

It should be understood that the arrangement of the slitters 64 on the lower side of the zipper Z is substantially the same as on the upper side with the result that each fastener element is cut on the opposite sides of the tape without the tape itself being disturbed. As shown in FIG. 9, the slitting of the elements adjacent the sewing thread O results in the falling away of the parts of fastener elements F from the rest of the zipper.

SEVERING THE CONNECTOR THREADS

It will be noted that in FIG. 4, with the heads locked in the position shown (by means which will be described), the upper head carries lancing means which serve to sever the connecting threads C. Generally, the lancing means is an L-shaped lancing element 70 which is mounted for reciprocal movement in the position shown in FIG. 3. The lower end of the element 70 is formed with a pair of lancing points 70*a* which are disposed outwardly respectively of the slitting blades 62*a* (FIG. 8). As shown, the upper end of the lancing element 70 carries an outward leg 72. A spiral spring 74 is disposed in compression between the underside of the leg 72 and the bottom of a well 76 formed in the plate 63. Thus, when the leg 72 is struck down, the lancer element 70 moves downward in the head and the lancer points 70*a* cut through upper level of connector threads, pierce the tape immediately therebelow and cut the respective connector threads on the lower level. Thereafter, the lancer points impinge upon lead slugs 80 (FIG. 10) formed in the grooved support bed 46.

MEANS FOR DRIVING THE PULL ROLL AND GAPPING MECHANISM

As described, the zipper chain Z is drawn from its supply reel 20 through the convolutions shown and across the grooved bed 46 by the powered pull roll 26 over which the zipper is trained. Clampingly holding the tape in driving association with the roll 26 is the roll 28 which is mounted on the end of an arm 90 which is in turn pivoted to the frame of the pull unit 18 by the rod 92. The rod continues interiorly of the unit in a bellcrank 94 to which a link 96 is pivotally attached and linked to a solenoid 98.

Thus, when it is desired to interrupt the pulling of the tape, the solenoid 98 may be activated to move the idler roller 28 leftwardly so that the zipper slips on the periphery of the pull roll 26. The normal position of the idler roll 28 is as shown except that the roll may be drawn leftwardly against a spring-pressed mounting (not shown) on the rod 92. It will be understood that the roller 30 rotates continuously, being driven by the motor 22 through the chain 24 trained over a sprocket 30.

Interiorly of the housing 14, the chain is also in engagement with the sprocket 102 (FIG. 12) which continuously drives the outer hub 104 of a clutch 105 typically as described in the U.S. Pat. No. 3,520,730 which issued July 28, 1970 to Weatherbee. The clutch is of the helical spring-type which permits a part rotation when its stop lever (not shown) is raised by a solenoid also not shown. The part rotation as described is imparted by the clutch to the shaft 106 journaled in bearings in both the front and rear walls of the housing 14.

The shaft 106 intermediate the walls mounts a spur gear 108 which is formed with teeth over only part of its periphery, said teeth being adapted to engage with the teeth on the pinion 54 therebelow for reasons which will be explained.

Figure 11:
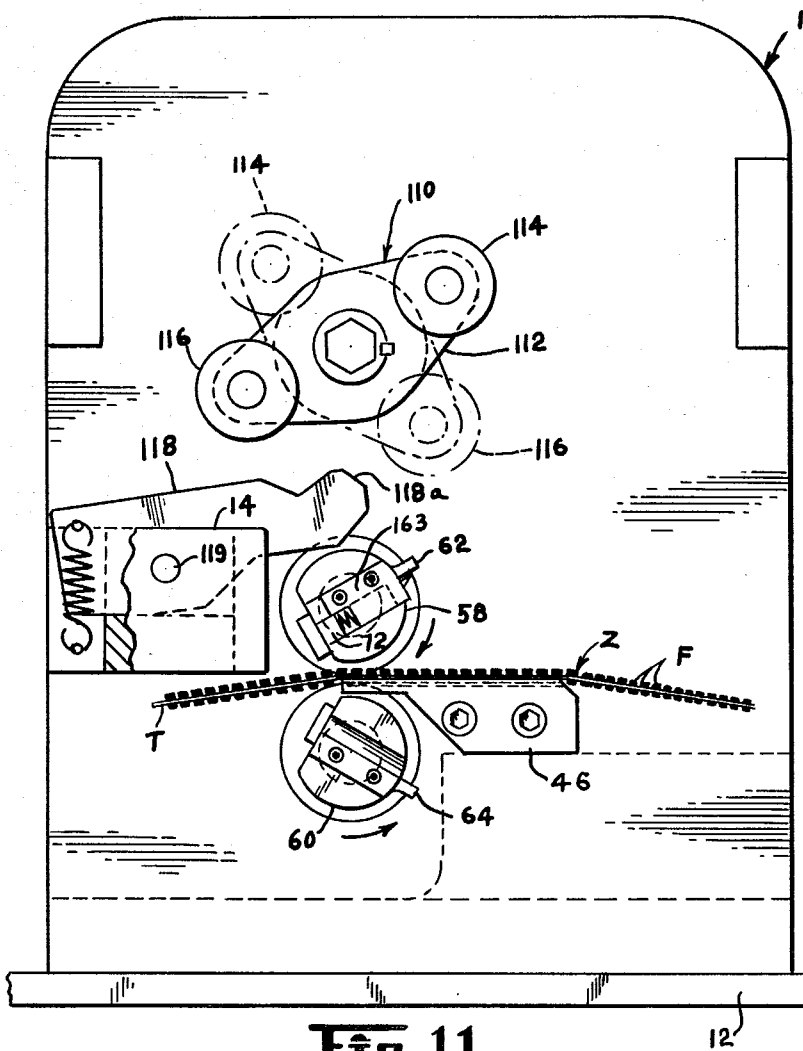
FIG. 11 is an enlarged view of the main housing of an apparatus embodying the invention showing the lancer cam in home position in solid lines and in neutral position in broken lines.

On its front end, the shaft 106 carries the roller hammer assembly 110 which comprises a diamond-shaped fixture 112 which serves as the lancer cam having spaced from its axis spindles on which are mounted the striking rollers 114 and 116 respectively. Disposed beneath the lancer cam 112 is a hammer 118 which is pivoted to the housing 14 at 119 and is upwardly biased (FIG. 11). It includes the upwardly pointing finger **118*a* in the path of the striking rollers 114, 116 as the lancer cam 112** rotates.

It will be understood that, as the fixture 112 rotates and the rollers 114, 116 alternately strike the hammer 118, the hammer 118 in turn knocks downward against leg 72 of the lancer element 70 causing the lancer point to move downward to its limit shown in FIG. 10.

Figure 13:
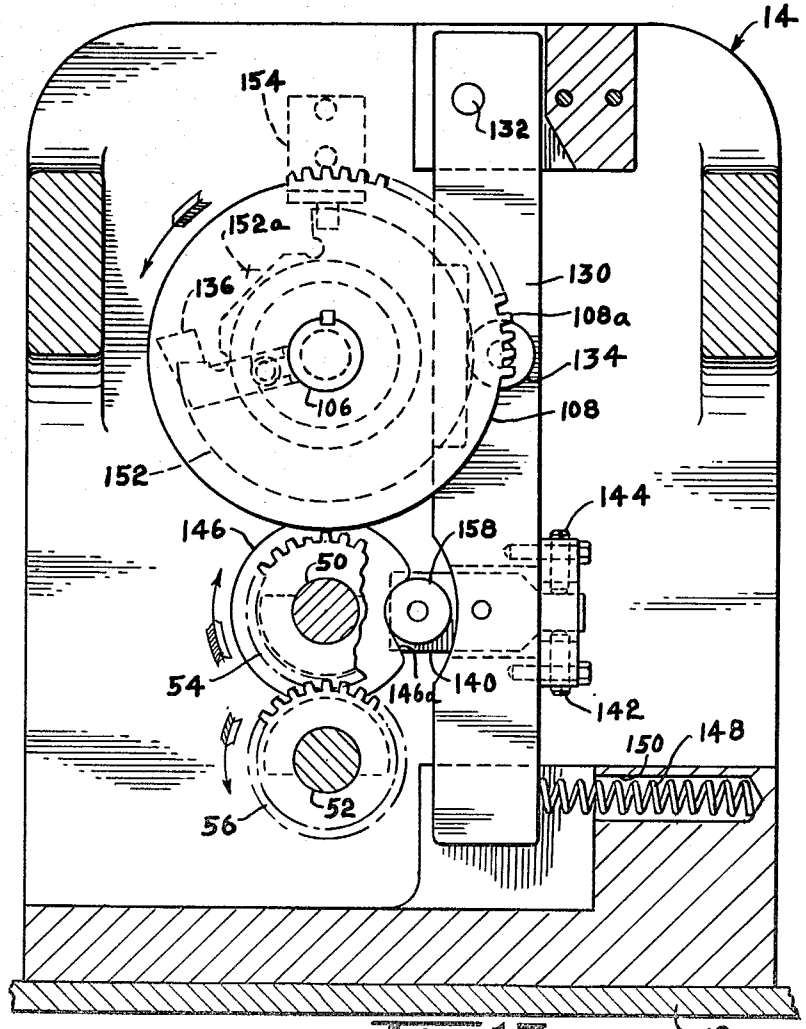
FIG. 13 is a sectional view taken on the line 13—13 of FIG. 12.

To assure that the heads 58 and 60 do not rotate from their working positions as shown in FIG. 3, a lock is provided. This comprises, as shown in FIG. 13, the arm 130 pivoted at its upper end on the pin 132 in the housing. The arm carries the cam follower roller 134 which is engaged by the cam 136 secured to the hub of the spur 108 as the latter rotates. Downward from the spur, a locking or detent roller 138 is rotatably mounted on the arm 140 which is in turn pivotally attached to the arm and adapted to be raised or lowered with respect to the arm by the set screws 142, 144 mounted in threaded openings on bosses provided on the arm, as shown (FIG. 13).

A locking disc 146 is mounted on the shaft 50 and has the locking recess **146*a* into which the roller 138 snaps for the locking effect on the gear train described. Assuring that the roller 38 is firmly held in the recess 146*a* is the stout compression spring 148 disposed between the lower end of the arm 130 and the bottom of a horizontal well 150 in the housing 14**.

With the roller 138 in the locking recess **146*a*, the heads 58, 60 are held in the position shown in FIG. 13 without straying. Even the hammer 118 striking against leg 72** has no effect on the angular disposition of the heads.

It should be noted that the rearward end of the shaft 106 mounts an opaque disc 152 which is formed with a window **152*a*. Mounted on the rear wall of the frame just above the disc 152 is the sensor 154 which, as the disc rotates, detects by photo-electric means the beginning passage and end of the window 152*a*** and registers same in the control station for reasons which will be made clear.

OPERATION

From the above description, the operation of the structure will be clear. Assuming that the apparatus is pulling chain through and is approaching a gap operation, the motor 100 runs with the solenoid 98 in unactivated condition so that the idler 28 is firmly against zipper Z assuring its movement with the wheel 26. The endless zipper chain progresses through the path as shown in FIG. 1, turning the counting wheel 32.

When the control station 16 from the position of the counting wheel detects that the preset point for the start of a gap is approaching, it activates the solenoid 98 and the solenoid associated with the clutch 104.

Activation of solenoid 98 causes the wheel 28 to move away from wheel 26 and the zipper chain Z to slip on wheel 26 and the pulling of the chain to cease.

Activation of the solenoid connected with the spring-wound clutch 105 commences a partial (90°) rotation of shaft 106.

The rotation of shaft 106 means, of course, the rotation of the spur 108 which rotates until its toothed segments engage the pinion 54 to rotate it which in turn rotates the meshing pinion 56. This causes the two heads 58 and 60 to rotate in the direction of the arrows (FIG. 11). As the slitters 62 and 64 on these heads approach (see dotted line view FIG. 3) their working position shown in FIG. 3, they engage inbetween fastener elements of the zipper Z and move leftwardly to the position shown in full lines in FIG. 3 dragging the zipper with them for this short distance. This assures the registration of the slitters with the first elements to be slit on the top and bottom of the tape. When the slitters have reached the position shown in FIG. 3, the wheel 138 snaps into the locking recess **146*a* of the disc 146 and stays there for the balance of the gapping operation. It is to be noted that at this point the toothed segment 108*a* of the spur 108 has rotated past engagement with the pinion 54, and the pinions 54 and 56** are no longer driven.

Continued rotation of the spur 108 causes the partial rotation of the lancer cam 112 so that the wheel 116 strikes the hammer 118 to in turn hit leg 72 and drive the lancer **70*a* downward to cut the connecting cords C as described, piercing the tape at that point. The spring 74 immediately raises the lancer element upon the passage of the roller 116. At this point, the clutch 105 disengages and the shaft 106 comes to rest with the rollers 114, 116 in the dotted line or neutral position shown in FIG. 11**.

Sensor 154 detects the presence of the shaft 106 at this attitude as the end of the window **152*a* passes the sensor and it signals the control station 16 which in turn deactivates solenoid 98 to tighten the idler roller 28 against roller 30 and recommences the pulling of the zipper Z this time with the slitters 62 and 64** engaged. The gap is thus formed.

The slitting operation continues until the counter roller 32 and related electronic equipment detect the passage of a sufficient length of gap whereupon the solenoid 98 is once more activated by the control station, moving roll 28 leftward to release the hold of the roll 26 on the zipper Z thereby stopping the tape. This done, the control unit 16 activates the solenoid (not shown) associated with the clutch 105 to commence another port rotation (270°) of the shaft 106. This causes the lancer cam 112 to rotate and the roller 114 to strike the hammer 118 which drives down the lancer element 70 for a second time, cutting the connecting threads at the end of the gap.

Immediately after the striking, the spring 74 forces the lancer element 70 upward and the gap is complete.

Figure 14:
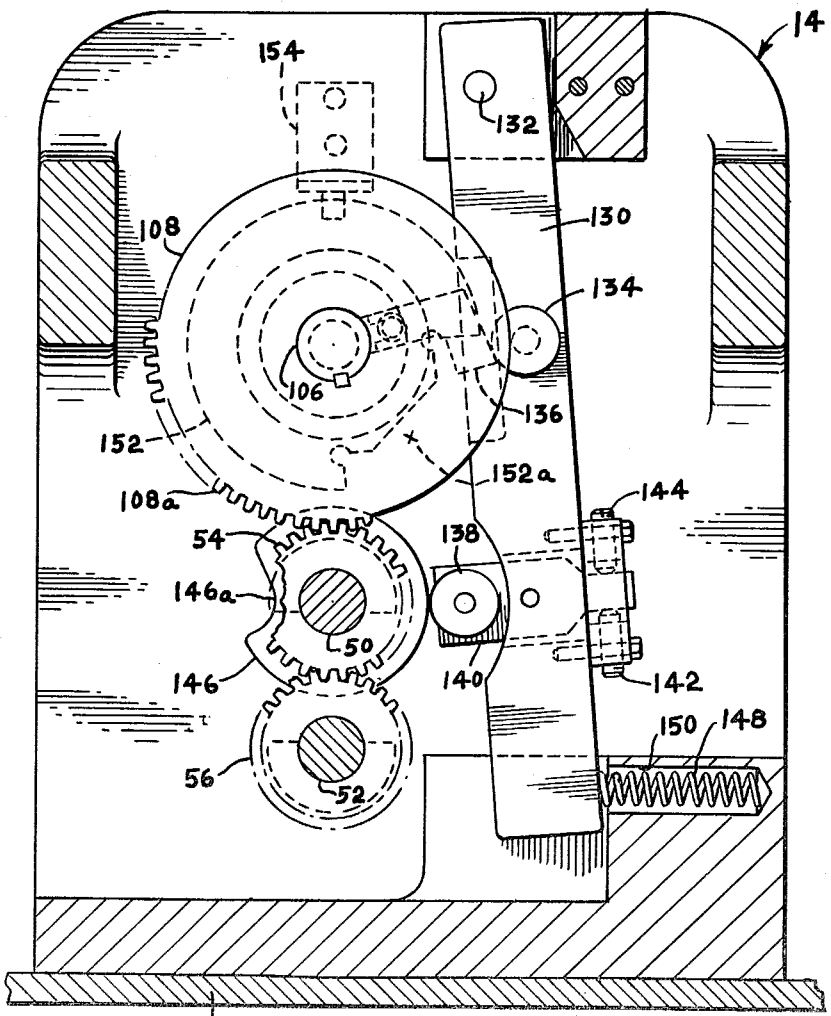
FIG. 14 is a view comparable to FIG. 13 but showing the detent arm in its outward position.

The shaft 106 continuing its rotation (FIG. 14), the cam 136 engages roller 134 and shoves the locking arm rightwardly as shown to raise the detent wheel 138 out of recess 146*a* and unlocks the heads 58 and 60. Subsequently, section 108*a* of gear 108 engages pinion 54 and rotates it together with pinion 56 so that the heads 58 and 60 take the positions of FIG. 2 and the lancer cam is in the home solid line position of FIG. 2.

Continued rotation of shaft 106 returns the beginning of the window 152*a* to the vicinity of the sensor 154 to give a completion signal to the control station 16 that the gap is complete. At this point the clutch 105 has disengaged, the 290° having been achieved. The sector 108*a* still engages the gear 54, ready for the initiation of the next gap.

Having received the completion signal, the control station, if programed for another cycle, commences with the deactivation of the solenoid, etc.

It should be clear from the above description that apparatus for gapping zipper chain in accordance with the present invention is especially adapted for the type of zipper described wherein the U-shaped plastic elements are held together by connector threads. At the same time, it should be clear that the present device keeps the sewing threads intact and does not harm the secure stitching of the elements to the tape at the commencement and end of the gap.

It will be clear that many variations of the present invention are possible, all falling within the scope of the appended claim language

We claim:

1. An apparatus for making a gap in a zipper chain having lines of fastener elements each comprising a U-shaped element joined by connector threads embedded therein, the apparatus comprising:

(a) a housing;

(b) a pair of opposed aligned heads rotatably supported on spaced parallel axes in the housing, the heads each mounting slitters extending outward from the axis of the head, the heads being adapted to assume a working position wherein the slitters face each other, the slitters being aligned with and engaging the fastener elements of the chain when the slitters are in the working position;

(c) means to rotate the heads in opposite senses of rotation and hold the heads from rotating when the slitters are in the working position;

(d) means to guide the chain between the heads so that their fastener elements are in line with the slitters;

(e) means to draw the chain between the slitters to thereby slit and demolish the elements.

2. An apparatus as claimed in claim 1 wherein one of the heads reciprocally mounts a pointed lancer adjacent its slitter and being capable of moving from a retracted position to an extended position in which it extends through the zipper chain whereby the lancer in moving from the retracted position to the extended position severs the connecting threads on both sides of the chain.

3. An apparatus as claimed in claim 2 wherein the lancer is biased in the retracted position and means are provided to forceably move the lancer to the extended position when the heads are in the first position in order to sever the connecting threads.

4. An apparatus for removing a section of the lines of fastener elements from the stringers of a zipper fastener chain in which the lines of fastener elements comprise aligned U-shaped elements each with a pair of parallel legs and an enlarged head at the bight, the fastener elements having a pair of connecting threads embedded in the legs thereof respectively holding them in spaced relation, the U-shaped elements of each stringer straddling their respective stringer tapes and being secured thereto respectively by lines of stitching, the apparatus comprising:

(a) a frame;

(b) means in the frame for pulling the interengaged chain through the machine in a path;

(c) a pair of slitters disposed on opposite sides of the path and pivotally mounted on the frame and adapted to swing toward the path to a first position at which the slitters are adapted to cut the legs on the opposite side of the chain;

(d) a pair of lancer means adapted when the slitters are in the first position to be made to extend through the path to cut the threads;

(e) means for driving these lancers to the extended position and returning them to the retracted position.

* * * * *

UNITED STATES PATENT AND TRADEMARK OFFICE

CERTIFICATE OF CORRECTION

PATENT NO. : 4,206,669

DATED : June 10,1980

INVENTOR(S) : Harry Fisher, et al

It is certified that error appears in the above—identified patent and that said Letters Patent is hereby corrected as shown below:

The title page should be deleted to insert the attached title page therefor.

Signed and Sealed this

*Twelfth* Day of *August 1980*

[SEAL]

*Attest:*

SIDNEY A. DIAMOND

*Attesting Officer*

*Commissioner of Patents and Trademarks*

United States Patent [19]

Fisher et al.

[11] 4,206,669

[45] Jun. 10, 1980

[54] APPARATUS FOR GAPPING ZIPPER CHAIN

[75] Inventors: Harry Fisher; Stuart Fisher, both of Whitestone, N.Y.

[73] Assignee: Scovill Manufacturing Company, Waterbury, Conn.

[21] Appl. No.: 960,942

[22] Filed: Nov. 15, 1978

[51] Int. Cl.[2] ..... B29D 5/00

[52] U.S. Cl. ..... 83/212.1; 83/302; 83/921; 83/431; 83/436; 29/770; 29/408

[58] Field of Search ..... 83/921, 208, 212, 213, 83/214, 218, 302, 407, 431, 436; 29/766, 770, 408

[56] References Cited

U.S. PATENT DOCUMENTS

| | | | |
|---|---|---|---|
| 1,762,330 | 6/1930 | Fiedler et al. | 83/302 |
| 2,752,997 | 7/1956 | Soave | 83/436 |
| 3,611,545 | 10/1971 | Takamatsu | 29/408 |
| 3,831,474 | 8/1974 | Perlman | 83/921 |
| 3,844,017 | 10/1974 | Fisher et al. | 29/770 |
| 3,848,500 | 11/1974 | Takahashi | 83/921 |
| 3,913,432 | 10/1975 | Thaler et al. | 83/921 |

*Primary Examiner*—Donald R. Schran
*Attorney, Agent, or Firm*—Dallett Hoopes

[57] ABSTRACT

Apparatus for producing gaps in zipper chain is especially adapted for chain having plastic elements of U-shape joined by imbedded connector threads and stitched to tape. Apparatus includes slitting means which slice into and demolish fastener elements in the gap as the zipper is drawn along, and lancer elements which are periodically activated to cut the connecting threads at the beginning and end of the gap. Stitches and tape in gap are left intact.

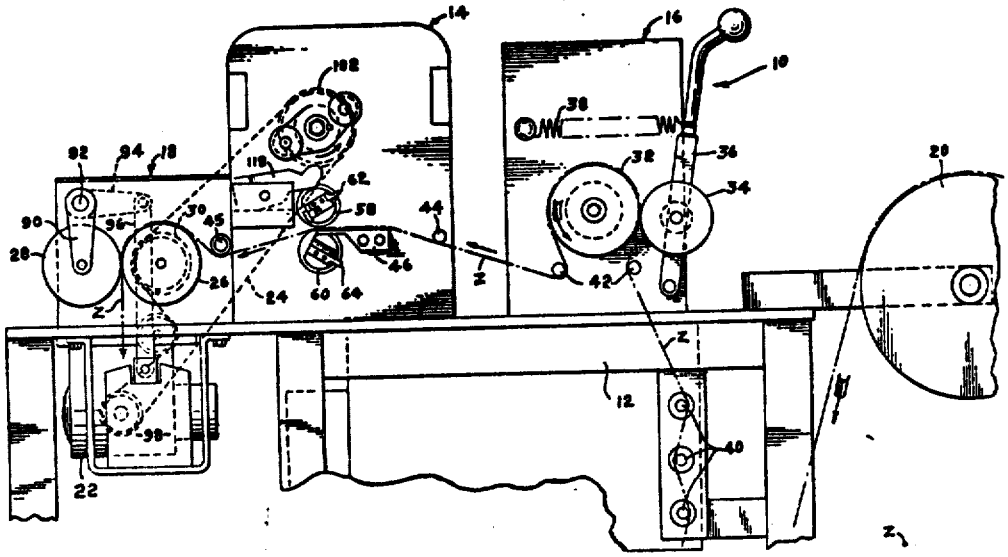

4 Claims, 15 Drawing Figures